US006047154A

United States Patent [19]

Kawaguchi

[11] Patent Number: 6,047,154

[45] Date of Patent: Apr. 4, 2000

[54] DEVELOPING APPARATUS

[75] Inventor: Hiroshi Kawaguchi, Kawasaki, Japan

[73] Assignee: Kabushiki Kaisha Toshiba, Kawasaki, Japan

[21] Appl. No.: 09/158,288

[22] Filed: Sep. 22, 1998

[30] Foreign Application Priority Data

Sep. 22, 1997 [JP] Japan ..... 9-275111

[51] Int. Cl.[7] ..... G03G 15/08; G03G 15/09

[52] U.S. Cl. ..... 399/264; 399/104; 399/277

[58] Field of Search ..... 399/99, 104, 264, 399/277

[56] References Cited

U.S. PATENT DOCUMENTS

| | | | |
|---|---|---|---|
| 4,457,257 | 7/1984 | Murakami et al. | 399/264 |
| 4,671,641 | 6/1987 | Kohyama | 399/264 |
| 4,868,607 | 9/1989 | Folkins et al. | 399/264 |
| 5,187,529 | 2/1993 | Nakayama | 399/264 |
| 5,379,094 | 1/1995 | Wing et al. | 399/264 |
| 5,404,215 | 4/1995 | Bares | 399/264 |
| 5,503,106 | 4/1996 | Kaneko | 399/777 X |
| 5,752,138 | 5/1998 | Wing et al. | 399/264 |

FOREIGN PATENT DOCUMENTS 8-2685 1/1996 Japan .

*Primary Examiner*—Fred L. Braun
*Attorney, Agent, or Firm*—Foley & Lardner

[57] ABSTRACT

A developing apparatus includes a developing device having a first magnetic pole opposed to an image carrier on which an electrostatic latent image is formed, and a second magnetic pole of the developing device arranged at a predetermined angle to the first magnetic pole, for supplying the electrostatic latent image with a developing agent having toner and carrier, where the second magnetic pole is of one polarity. The carrier collection device has a third magnetic pole of a polarity opposite to that of the second magnetic pole of the developing device, a fourth magnetic pole of a polarity equal to that of the second magnetic pole of the developing device, and a fifth magnetic pole of a polarity opposite to that of the second magnetic pole of the developing device, for collecting the carrier on the image carrier by the third magnetic pole and for carrying the collected carrier, by the fourth and fifth magnetic poles, the fourth magnetic pole being arranged to be opposed to the second magnetic pole of the developing device in the carrier collection device.

10 Claims, 2 Drawing Sheets

DEVELOPING APPARATUS

BACKGROUND OF THE INVENTION

The present invention relates to a developing apparatus applicable to an image forming apparatus which copies an image, based on image data obtained by optically reading an image of an object as brightness data.

For example, in a copying apparatus which uses electrostatic copying process, an image is copied by developing an electrostatic latent image corresponding to image data of a object to be copied, transmitted as brightness of light to a photosensitive material.

The photosensitive material is, for example, a drum-like photosensitive member in which a thin layer made of an inorganic or organic photosensitive material is formed on an outer circumference formed in a cylindrical shape.

A method used when developing an electrostatic latent image is such a method in which a toner is selectively applied as a visualizing agent to an electrostatic latent image on a photo-sensitive member by an electrostatic force between the toner and the electrostatic latent image.

A widely used method of supplying toner onto an electrostatic latent image on a photosensitive member is by two-component magnetic brush development in which a developing agent obtained by mixing a carrier for carrying the toner with the toner at a predetermined ratio being carried to the photosensitive material with use of a developing roller internally including a fixed magnet and having an outer circumferential surface arranged to be rotatable at a predetermined speed, thereby to apply only the toner onto the electrostatic latent image on the photosensitive member.

In the two-component magnetic brush development, at present, a carrier consisting of grains each having a small diameter, i.e., a small diameter carrier is used to improve the image quality.

However, the method of using a small diameter carrier has a problem that the carrier is applied together with the toner to the photosensitive material.

The carrier thus adhered to the photosensitive material may damage the surface of the photosensitive member and blades of any cleaning device when a toner image obtained by developing an electrostatic latent image is transferred to a recording paper sheet as a transfer medium.

Hence, a proposal has been made to an image forming apparatus in which a carrier collection device for collecting the carrier is provided in the vicinity of the photosensitive member, e.g., between the developing roller and the transfer device.

However, in the carrier collection device, a magnetic member capable of generating a particular magnetic field different from that generated by the developing roller, and the carrier is collected by the magnetic field generated by the magnetic member. Therefore, there is a problem that both magnetic fields generated by the developing device and by the carrier collection device complicatedly influence each other and the carrier is directly attracted to the collection device from the developing roller, depending on some conditions.

This phenomenon is caused when the magnetic force of the carrier collection device is greater than the magnetic force of the main pole of the developing roller and the carrier pole. Once this phenomenon has occurred, a problem appears in that the developing agent stays in the collection device and the efficiency of collecting the developing agent is greatly lowered.

Since the developing agent thus stays in the collection device, there occurs a problem that the developing agent is accumulated between the developing roller and the collection device, and the developing roller is locked so that the electrostatic latent image cannot be developed.

BRIEF SUMMARY OF THE INVENTION

The present invention has an object of providing a developing apparatus capable of securely collecting a carrier which sticks to a photosensitive material from a developing agent when an electrostatic latent image is developed with toner, and is capable of efficiently carrying the carrier thus collected, so that stable image formation is maintained.

The present invention has another object of providing an image forming apparatus capable of obtaining an image of good image quality by using a small diameter carrier.

According to the present invention, there is provided a developing apparatus comprising: developing means having a first magnetic pole opposed to an image carrier on which an electrostatic latent image is formed, and a second magnetic pole arranged at a predetermined angle to the first magnetic pole, for supplying the electrostatic latent image with developing agent having toner and carrier; and carrier collection means having a third magnetic pole of a polarity opposite to that of the second magnetic pole, a fourth magnetic pole of a polarity equal to that of the second magnetic pole, and a fifth magnetic pole of a polarity opposite to that of the second magnetic pole, for collecting the carrier on the image carrier by the third magnetic pole and for carrying the collected carrier, by the fourth and fifth magnetic poles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

In the following, embodiments of the present invention will be specifically explained with reference to the drawings.

Figure 1:
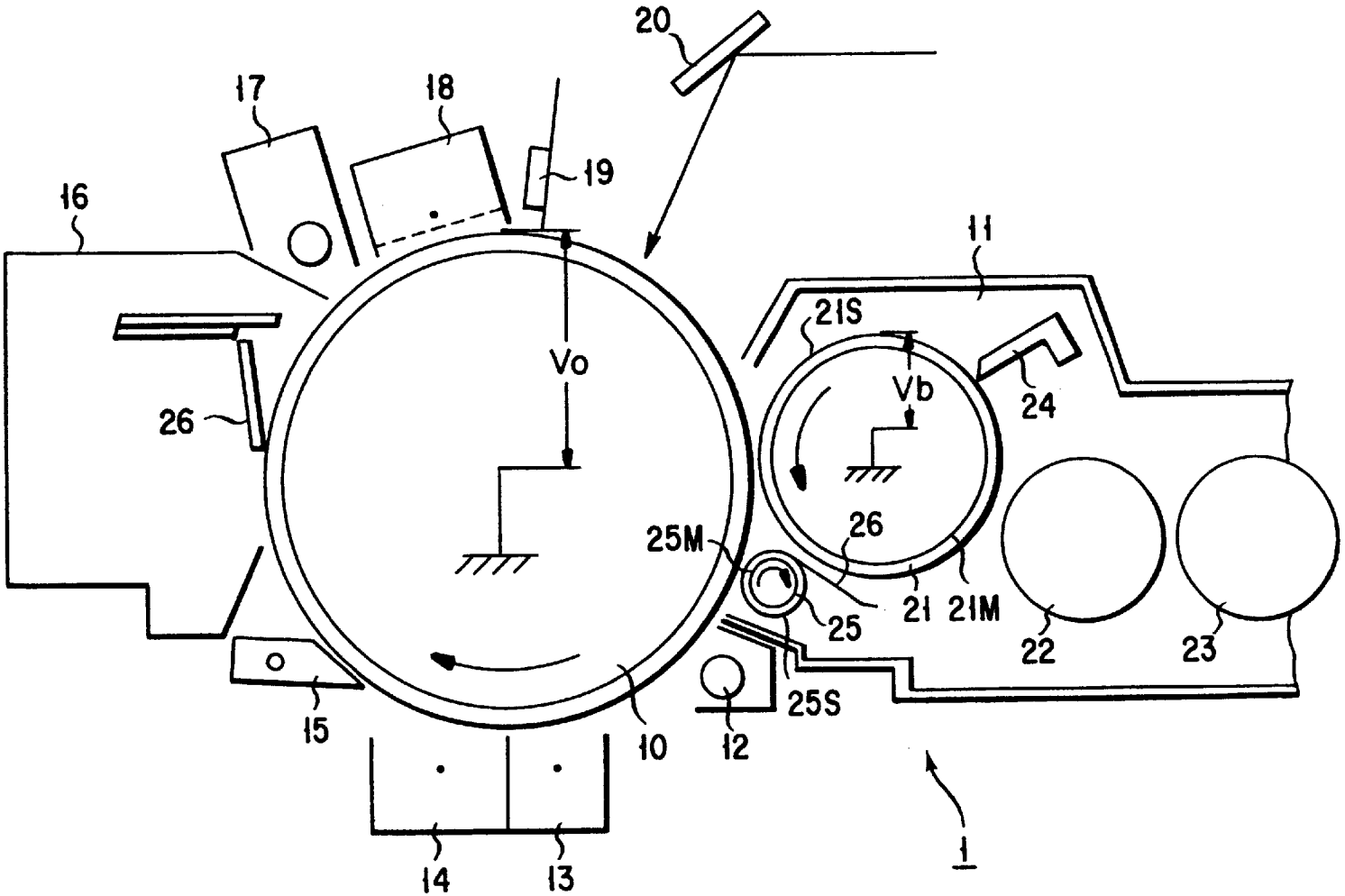
FIG. 1 is a schematic view explaining a main part of a copying machine to which a developing apparatus according to an embodiment of the present invention is applied, around a photosensitive drum.

FIG. 1 shows details of a copying machine adopting electrostatic copying process, enlarging mainly a developing device and a photosensitive drum thereof.

As shown in FIG. 1, in case of the photosensitive drum 10, light is irradiated onto an outer circumferential surface of a cylinder which is made of, for example, Al (aluminum) and which is charged to a predetermined potential, so that an electrostatic latent image is thereby formed and a predetermined length in the axial direction is obtained. Note that the photosensitive drum 10 is rotated at a predetermined speed corresponding to the copying magnification and the copying speed, by a drive motor not shown.

A developing apparatus 11, a pre-transfer discharger 12, a transfer device 13, a separator 14, a peeling device 15, a cleaning device 16, a discharger 17, a charger 18, and a partial erasure LED unit 19 are provided in this order around the photosensitive drum 10. The developing apparatus 11 serves as a developing means. The pre-transfer discharger 12 attenuates the electrostatic adhesion between toner and the photosensitive drum 10 before transfer is performed by the transfer device described below. The transfer device 13 transfers a toner image obtained by developing an electrostatic latent image formed on the photosensitive drum 10, by the developing device 11, onto a recording paper sheet. The separator 14 attenuates the electrostatic adhesion between a recording paper sheet onto which the toner image has been transferred by the transfer device 13 and the photosensitive drum 10. The peeling device 15 peels the recording paper sheet from the surface of the photosensitive drum 10. After the toner image is transferred to the recording paper sheet, the cleaning device 16 removes and collects toner remaining on the photosensitive drum 10 after the transfer. The discharger 17 removes charges remaining on the surface of the photosensitive drum 10. The charger 18 charges the photosensitive drum 10 to a predetermined surface potential. The partial erasure LED unit 19 selectively attenuates the potential of the photosensitive drum 10 charged by the charger 18, to form a non-image region.

Image data of an object as a copy target read in form of brightness data of light by an image reading portion not shown is exposed to the outer circumferential surface of the photosensitive drum 10 from the space between the developing apparatus 11 and the partial erasure LED unit 19 through a mirror 20.

The developing apparatus 11 has a developing roller 21 including a developing sleeve formed of a cylinder made of a non-magnetic material and magnets δ and ϵ (which will be explained later with reference to FIG. 2) fixed inside the developing sleeve.

A doctor blade 24 is provided at a predetermined position on the outer circumference of the developing roller 21, fixed with a predetermined distance maintained from the developing sleeve, and the doctor blade 24 serves to restrict the amount of a developing agent fed to the photosensitive drum 10 by the developing sleeve. A carrier collection device 25 for collecting the carrier adhered to the surface of the photosensitive drum 10 when developing an electrostatic latent image formed on the photosensitive drum 10 by the developing sleeve is provided at a position apart from the outer circumference of the photosensitive drum 10 by a predetermined distance, between the developing roller 21 and the pre-transfer discharger 12.

Figure 2:
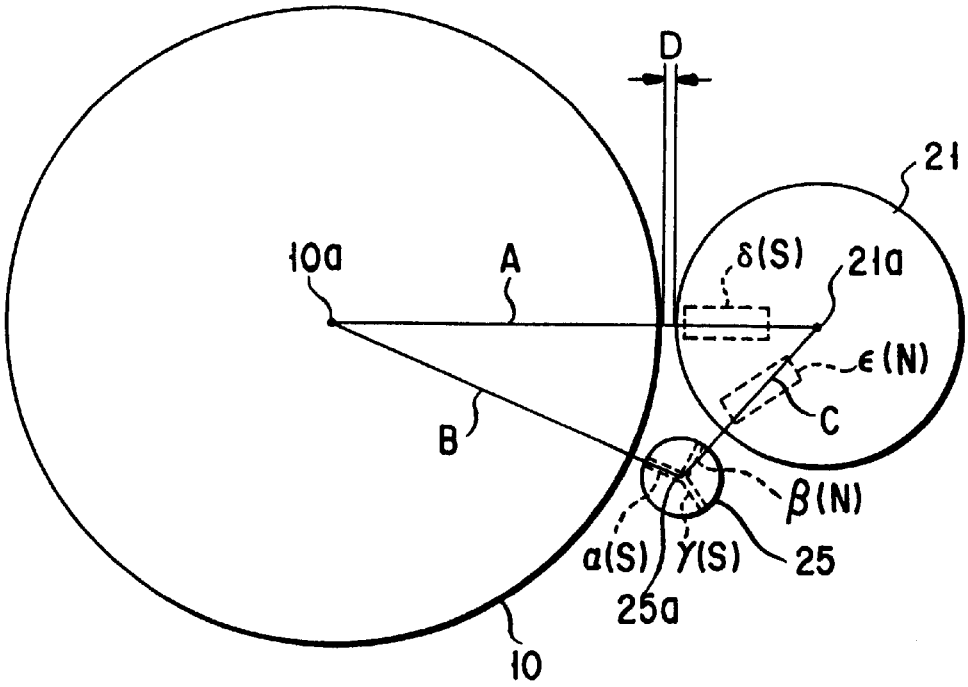
FIG. 2 is a partially enlarged view explaining a relationship between magnetic poles of a photosensitive drum of the copying machine shown in FIG. 1, a developing roller, and a carrier collection device.
Figure 3:
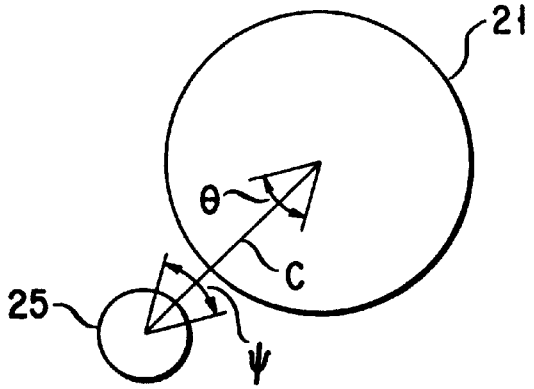
FIG. 3 is a schematic view explaining the magnetic pole of the developing roller of the developing device shown in FIG. 2 and the magnetic pole of the carrier collection device.

Next, the developing roller 21 and the carrier collection device 25 of the developing apparatus 11 will be specifically explained below with reference to FIG. 2.

An electrostatic latent image formed on the photosensitive drum 10 is developed with toner supplied from the developing device 11.

In developing, it is not possible to supply only the toner to an electrostatic latent image formed on the photosensitive drum 10 because of various factors such as a surface potential Vo of the photosensitive drum 10, a developing bias voltage Vb applied to the developing roller of the developing apparatus (e.g., toner and a carrier), a contrast potential $\Delta V=(Vo-Vb)/D$ defined by a distance D between the surface of the photosensitive drum 10 and the developing roller 21 of the developing apparatus 11, a centrifugal force generated by rotation of the developing roller 21 to make influences on toner and the carrier, and characteristics inherent to the toner and the carrier. Therefore, it is not possible to avoid adhesion of the carrier to the photosensitive drum 10, i.e., carrier adhesion.

From the above, explanation will be specifically made of a method of optimizing the relationship between the carrier collection device 25 and the developing roller 11 and of securely carrying the carrier collected by the carrier collection device into the developing device 11.

The rotation center 21*a* of the developing roller 21 and the rotation center 10*a* of the photosensitive drum 10 are positioned on a line A. The center 21*a* of the developing roller 21 and the rotation center 25*a* of the carrier collection device 25 are positioned on a line C. Meanwhile, the center 25*a* of the carrier collection device 25 and the center 10*a* of the photosensitive drum 10 are positioned on a line B.

The developing roller 21 is comprised of a developing sleeve 21S and a fixed magnet 21M positioned inside the developing sleeve 21S. The fixed magnet is provided with a first magnetic pole δ having an S pole magnetized such that the direction of the line of magnetic force rises along the line A, a second magnetic pole ϵ having an N pole magnetized such that the direction of the line of magnetic force rises substantially in parallel with the line C, and other two or three magnetic poles not shown in addition to the first and second magnetic poles. Note that the developing sleeve 21S is rotated in a direction opposite to the direction in which the photosensitive drum 10 is rotated, such that the direction in which the outer circumference of the sleeve itself is the same direction as the moving direction of the surface of the photosensitive drum 10, at the position where the sleeve faces the surface of the drum. The sleeve circumference speed at which the outer circumference of the developing sleeve 21S moves is set to a predetermined rate to the drum circumference speed of the moving speed of the surface of the photosensitive drum 10. Further, the first magnetic pole δ corresponds to a known main pole and the second magnetic pole ϵ is called a carrier pole.

The carrier collection device 25 is comprised of a cylindrical collection sleeve 25S similar to the developing sleeve of the developing roller 21, and a fixed magnet 25M positioned inside the collection sleeve 25S. The fixed magnet 25M is provided with three magnetic poles consisting of a first magnetic pole ϵ having an S pole magnetized such that the direction of the line of magnetic force rises along the line B, a second magnetic pole β, having an N pole and a third magnetic pole γ having an S pole. The third magnetic pole γ is preferably provided at a position in the side opposite to the first magnetic pole α on the circumference such that the third magnetic pole γ is opposed to the first magnetic pole α. The second magnetic pole β is set within a range of 150 to 210° from a segment connecting the rotation centers of the collection roller 25 and the photosensitive drum 10 with each other. The polarity of the third magnetic pole γ is the same as that of the first magnetic pole α. Further, a carrier separation blade 26 is provided at a position in the direction opposite to the rotation direction of the collection sleeve 25S, in the vicinity of a segment connecting the second magnetic pole β and the second magnetic pole ϵ the developing roller 21 with each other, and the carrier separation blade 26 serves to scratch off the carrier collected by a carrier collection function described later, from the surface of the collection sleeve 25S.

The second magnetic pole β has a polarity opposite to the polarity of the first and third magnetic poles α and γ. The first magnetic pole α functions as a carrier collection pole, and the second and third magnetic poles β and γ function as carrier poles for carrying the carrier collected by the first magnetic pole α.

The collection roller circumferential speed at which the outer circumferential surface of the collection sleeve 25S is preferably set to 3 to 30 mm/s.

Next, explanation will be made of a developing agent in the developing device 11 (e.g., a particular material in which toner and a carrier are mixed at a predetermined ratio.

The developing agent introduced into the housing is carried to the rear side (or front side) in the direction perpendicular to the paper surface of FIG. 1 by a second mixer 23 shown in FIG. 1. Meanwhile, the first mixer carries the developing agent carried by the second mixer 23 to the front side (or back side) in the opposite direction, i.e., in the direction perpendicular to the paper surface of FIG. 1. Therefore, the developing agent introduced into the housing by the rotation of the first and second mixers is circulated in the housing and is thereby frictionally electrified to a predetermined potential.

A predetermined amount of the developing agent circulated in the housing by the rotation of the first and second mixers is attracted to a magnetic pole not shown of the fixed magnet 21M of the developing roller 21, and is carried to the doctor blade 24 shown in FIG. 1 by rotation of the developing sleeve 21S.

The developing agent carried to the vicinity of the doctor blade 24 is attracted to a magnetic pole not shown, provided in the vicinity of the doctor blade 24, and is carried to a developing position where the photosensitive drum 10 and the developing sleeve 21S are opposed to each other. Note that the developing position is defined to be in the vicinity of a position at which the line A and the developing sleeve 21S cross each other.

The developing agent carried to the developing position is composed like a brush along the line of magnetic force from the first magnetic pole δ and only toner is supplied to an electrostatic latent image on the surface of the opposed photosensitive drum 10.

At the developing position, the developing agent on the developing sleeve 21S, which has formed a magnetic brush and supplied toner to the electrostatic latent image on the photosensitive drum 10, is collected into the housing by a magnetic force from the second magnetic pole ϵ of the developing roller 21 and by rotation of the developing sleeve 21S, so that the developing agent is mixed with the developing agent supplied from the first mixer 22 to the developing sleeve 21S.

In this manner, the developing agent, which has been used for developing the electrostatic latent image on the photosensitive drum 10 and whose toner density has been changed, is returned again to the step of frictional electrification performed by the first and second mixers 22 and 23. In the step of frictional electrification, an amount of toner corresponding to a difference between the toner density detected by a toner density sensor not shown and a reference is charged from a toner tank not shown, and is stirred and frictionally electrified by the first and second mixers, to be supplied to the developing sleeve 21S.

Meanwhile, a more or less amount of carrier of the developing agent sticks to the surface of the photosensitive drum 10 when a magnetic brush is formed and an electrostatic latent image is developed in a manner in which the developing agent is composed like a brush toward the surface of the photosensitive drum 10 in the vicinity of the first magnetic pole δ of the developing roller 21, as has been described before.

The carrier sticking to the photosensitive drum 10 is attracted to the first magnetic pole α of the carrier collection device 25 and is carried in the direction in which the collection sleeve 25S is rotated, by the magnetic force of the second magnetic pole β. The carrier is further carried by the magnetic force of the third magnetic pole γ. As a result, the carrier is carried into the housing of the developing device 11 by rotation of the collection sleeve 25S. Note that the carrier carried into the housing by the collection sleeve 25S is separated from the collection sleeve 25S by the collection blade 26 and is guided to the inside of the housing by the magnetic force from the second magnetic pole ϵ. Therefore, the direction in which the collection sleeve is rotated is opposite to the direction in which the developing sleeve is rotated.

As has been explained before, each of the developing roller 21 and the carrier collection device 25 includes a plurality of a fixed magnet arranged such that a plurality of magnetic poles are arranged at predetermined angles in a cross-section, and a sleeve rotated around the outer circumference of the fixed magnet. It is therefore necessary to optimize magnetic forces G applied to the magnetic poles of both the roller 21 and the device 25, the polarities of the poles of the developing roller and the carrier collection device, and the arrangement of the poles of the developing roller and the carrier collection device.

In the following, detailed explanation will be made of the magnetic forces G of the second magnetic pole ϵ of the fixed magnet 21M of the developing roller 21 and the first and second magnetic poles α and β of the fixed magnet 25M of the carrier collection device 25, the relationship between the magnetic poles of the developing roller and the carrier collection device, and the relationship between the arrangement of the magnetic poles of the developing roller and the arrangement of the magnetic poles of the carrier collection device.

Table 1 shows carrier adhesion forces, an ability of carrying a developing agent, and accumulation of a developing agent in the carrier collection device, where various combinations were practiced with respect to the polarities of the magnetic poles of the developing roller and the carrier collection device, the positions of the magnetic poles of the developing roller and the carrier collection device, the magnetic forces of the magnetic poles, the sleeve circumference speed of the developing sleeve of the developing roller, and the polarities of the second magnetic pole ϵ of the developing roller and the second magnetic pole β of the carrier collection device 25. In Table 1, each angle indicates a range which can be taken by θ and ϕ sandwiching a segment C connecting the center of the developing roller 21 and the center of the carrier collection device 25 with each other. Note that the angle of the first magnetic pole α of the carrier collection device 25 indicates the setting with respect to the line B shown in FIG. 2.

The columns "a" of the magnetic forces and the columns "a" of the angles show setting related to the second magnetic pole β of the carrier collection device 25. Likewise, the columns "b" of the magnetic forces and the columns "b" of the angles show setting related to the second magnetic pole ϵ of the developing roller 21, while the columns "c" of the magnetic forces and the columns "c" of the angles show setting related to the first magnetic pole α of the carrier collection device 25. In the columns of the carrier adhesion force, the ability of carrying the developing agent, and the accumulation of the developing agent in the carrier collection device, marks "○", "Δ", and "x" respectively indicates "substantially good", "setting should be changed", and "unable to use". Although the polarities are basically equal polarities, it will be apparent that a carrier is injected to the magnetic pole ϵ of the developing roller 21 in case of opposite polarities.

segment defined in relation to the magnetic pole ϵ of the developing roller 21.

The magnetic force of the first magnetic pole α of the carrier collection device 25 is 600 to 1200 G.

The direction of the line of the magnetic force of the pole α is within a range of ±10° with respect to the segment defined in relation to the center of the photosensitive drum 10.

The magnetic force of the second magnetic pole ϵ of the developing roller 21 is 500 to 1500 G.

The direction of the line of the magnetic force of the magnetic pole ϵ is within a range of ±10° with respect to the

TABLE 1

| | POLARITIES | MAGNETIC FOR (G) | | | ANGLE (°) | | |
|---|---|---|---|---|---|---|---|
| | OF β AND ϵ | a | b | c | a' | b' | c' |
| EMBODIMENT | | | | | | | |
| 1 | SAME | 500 to 1500 | 500 to 1500 | 600 to 1200 | 0 ± 10 | 0 ± 10 | 0 ± 10 |
| 2 | SAME | 500 to 1500 | 500 to 1500 | 600 to 1200 | 0 ± 10 | 0 ± 10 | 0 ± 10 |
| 3 | SAME | 500 to 1500 | 500 to 1500 | 600 to 1200 | 0 ± 10 | 0 ± 10 | 0 ± 10 |
| 4 | SAME | 500 to 1500 | 500 to 1500 | 600 to 1200 | 0 ± 10 | 0 ± 10 | c' > 10 |
| 5 | SAME | 500 to 1500 | 500 to 1500 | 600 to 1200 | 0 ± 10 | 0 ± 10 | c' > −10 |
| 6 | SAME | 500 to 1500 | 500 to 1500 | 600 to 1200 | 0 ± 10 | b' > 10 | 0 ± 10 |
| 7 | SAME | 500 to 1500 | 500 to 1500 | 600 to 1200 | 0 ± 10 | b' > −10 | 0 ± 10 |
| 8 | SAME | 500 to 1500 | 500 to 1500 | 600 to 1200 | a' > 10 | 0 ± 10 | 0 ± 10 |
| 9 | SAME | 500 to 1500 | 500 to 1500 | 600 to 1200 | a' > −10 | 0 ± 10 | 0 ± 10 |
| 10 | SAME | 500 to 1500 | 500 to 1500 | c > 1200 | 0 ± 10 | 0 ± 10 | 0 ± 10 |
| 11 | SAME | 500 to 1500 | 500 to 1500 | c < 600 | 0 ± 10 | 0 ± 10 | 0 ± 10 |
| 12 | SAME | 500 to 1500 | b > 1500 | 600 to 1200 | 0 ± 10 | 0 ± 10 | 0 ± 10 |
| 13 | SAME | 500 to 1500 | b > 500 | 600 to 1200 | 0 ± 10 | 0 ± 10 | 0 ± 10 |
| 14 | SAME | a > 1500 | 500 to 1500 | 600 to 1200 | 0 ± 10 | 0 ± 10 | 0 ± 10 |
| 15 | SAME | a < 500 | 500 to 1500 | 600 to 1200 | 0 ± 10 | 0 ± 10 | 0 ± 10 |
| COMPARATIVE EXAMPLE | OPPOSITE | 500 to 1500 | 500 to 1500 | 600 to 1200 | 0 ± 10 | 0 ± 10 | 0 ± 10 |

| | d:CIRCUMFERENTIAL SPEED (mm/sec.) | CARRIER ADHESION | ABILITY OF CARRYING DEVELOPING AGENT | ACCUMULATION OF DEVELOPING AGENT | TOTAL EVALUATION |
|---|---|---|---|---|---|
| EMBODIMENT | | | | | |
| 1 | 3 TO 30 | ○ | ○ | ○ | ◎ |
| 2 | 3 TO 30 | ○ | X | X | X |
| 3 | 3 TO 30 | Δ | ○ | ○ | ○ |
| 4 | 3 TO 30 | Δ TO X | ○ | ○ | ○ |
| 5 | 3 TO 30 | Δ TO X | ○ | ○ | ○ |
| 6 | 3 TO 30 | ○ | ○ | Δ TO X | Δ TO X |
| 7 | 3 TO 30 | ○ | ○ | Δ TO X | Δ TO X |
| 8 | 3 TO 30 | ○ | ○ | Δ TO X | Δ TO X |
| 9 | 3 TO 30 | ○ | ○ | Δ TO X | Δ TO X |
| 10 | 3 TO 30 | ○ | Δ TO X | Δ TO X | Δ TO X |
| 11 | 3 TO 30 | Δ TO X | ○ | ○ | ○ |
| 12 | 3 TO 30 | ○ | Δ TO X | Δ TO X | Δ TO X |
| 13 | 3 TO 30 | ○ | Δ TO X | Δ TO X | Δ TO X |
| 14 | 3 TO 30 | ○ | Δ TO X | Δ TO X | Δ TO X |
| 15 | 3 TO 30 | ○ | ○ | Δ TO X | Δ TO X |
| COMPARATIVE EXAMPLE | 3 TO 30 | ○ | X | X | X |

Accordingly, as shown in the columns of the embodiment 1 in Table 1, the second magnetic pole ϵ of the fixed magnet 21M of the developing roller 21, and the first and second magnetic poles α and β of the fixed magnet 25M of the carrier collection device 25 are preferably set as follows.

The second magnetic pole β of the carrier collection device 25 is 500 to 1500 G.

The direction of the line of the magnetic force of the magnetic pole β is within a range of ±10° with respect to the segment defined in relation to the magnetic pole β of the carrier collection device 25.

As has been explained above, the image forming apparatus according to the present invention has a carrier collection device in which a magnetic pole set to the same polarity as that of the carrier pole positioned in the downstream side of the main pole of the developing roller of the developing device is used as a carrier pole. Therefore, the carrier sticking to a photosensitive material from a developing agent can be securely collected when developing an electrostatic latent image by toner, and the carrier thus collected can be efficiently carried to the developing roller. As a result, it is possible to provide an image forming apparatus capable of maintaining stable image forming conditions.

Specifically, according to the present invention, there are provided a collection magnetic pole in the carrier collection roller, and first and second carrier poles for carrying the carrier collected by the collection magnetic pole. In particular, the first magnetic pole is opposed to the carrier magnetic pole provided in the developing roller and these magnetic poles opposed to each other are set to have the same polarity as that of the carrier pole of the developing roller, so that the developing agent is prevented from being excessively accumulated between the collection roller and the developing roller. Accordingly, the carrier can be excellently collected without causing locking of the developing roller is not caused.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A developing apparatus comprising:

developing means having a first magnetic pole opposed to an image carrier on which an electrostatic latent image is formed, and a second magnetic pole arranged at a predetermined angle to the first magnetic pole, for supplying the electrostatic latent image with developing agent having toner and carrier, the second magnetic pole of the developing means having a polarity; and carrier collection means having a third magnetic pole of a polarity opposite to that of the second magnetic pole of the developing means, a fourth magnetic pole of a polarity equal to that of the second magnetic pole of the developing means, and a fifth magnetic pole of a polarity opposite to that of the second magnetic pole of the developing means, for collecting the carrier on the image carrier by the third magnetic pole and for carrying the collected carrier, by the fourth and fifth magnetic poles, the fourth magnetic pole being arranged to be opposed to the second magnetic pole of the developing means in the carrier collection means.

2. An apparatus according to claim 1, wherein the carrier collection means is a collection roller which rotates and the developing means is a developing roller which rotates.

3. An apparatus according to claim 2, wherein an angle defined between a line connecting a rotation center of the developing roller with a rotation center of the collection roller and a line connecting the rotation center of the developing roller with the second magnetic pole of the developing means is 10° or less.

4. An apparatus according to claim 2, wherein an angle defined between a line connecting the rotation center of the developing roller with the rotation center of the collection roller and a line connecting the rotation center of the developing roller with the fourth magnetic pole is 10° or less.

5. An apparatus according to claim 2, wherein the second magnetic pole of the developing means is situated with a range of 150 to 210° with respect to a line connecting a center of an image holding member with the center of the collection roller.

6. An apparatus according to claim 2, wherein a roller circumference speed at which an outer circumferential surface of the collection roller is moved is 3 to 30 mm/s.

7. An apparatus according to claim 2, wherein the collection roller rotates in a same direction as a rotation direction of an image holding member, and the collection roller and the developing roller respectively rotate in directions opposite to each other.

8. An apparatus according to claim 2, wherein the collection roller is provided with a blade for scratching off the carrier collected.

9. An apparatus according to claim 1, wherein the second magnetic pole of the developing means has a magnetic force of 500 to 1500 gausses and the fourth magnetic pole has a magnetic force of 500 to 1500 gausses.

10. A developing apparatus comprising:

developing means having a first magnetic pole opposed to an image carrier member on which an electrostatic latent image is formed, and a second magnetic pole arranged at a predetermined angle to the first magnetic pole, for supplying the electrostatic latent image with a developing agent having toner and carrier, the second magnetic pole of the developing means having a polarity; and carrier collection means having a third magnetic pole of a polarity opposite to that of the second magnetic pole of the developing means, a fourth magnetic pole of a polarity equal to that of the second magnetic pole of the developing means, and a fifth magnetic pole of a polarity opposite to that of the second magnetic pole of the developing means, for collecting the carrier on the image carrier by the third magnetic pole and for carrying the collected carrier, by the fourth and fifth magnetic poles.

* * * * *

UNITED STATES PATENT AND TRADEMARK OFFICE

CERTIFICATE OF CORRECTION

PATENT NO. : 6,047,154
DATED : April 4, 2000
INVENTOR(S) : Hiroshi Kawaguchi

It is certified that error appears in the above-identified patent and that said Letters Patent is hereby corrected as shown below:

In the Title :

After "DEVELOPING APPARATUS" insert-- FOR PREVENTING EXCESSIVE ACCUMULATION OF DEVELOPING AGENT BETWEEN THE COLLECTION AND DEVELOPING ROLLERS --

Signed and Sealed this

Fifth Day of June, 2001

Nicholas P. Godici

*Attest:*

NICHOLAS P. GODICI

*Attesting Officer*

*Acting Director of the United States Patent and Trademark Office*